US005407078A

United States Patent [19]

Strauser

[11] Patent Number: 5,407,078

[45] Date of Patent: Apr. 18, 1995

[54] PERIMETER PACKAGE FOR ARTICLES

[75] Inventor: Buford R. Strauser, Wentzville, Mo.

[73] Assignee: Innovative Enterprises, Inc., Washington, Mo.

[21] Appl. No.: 119,654

[22] Filed: Sep. 13, 1993

[51] Int. Cl.[6] ..... B65D 19/00

[52] U.S. Cl. ..... 206/599; 206/320; 206/326; 206/600

[58] Field of Search ..... 53/397, 399, 441; 206/83.5, 320, 326, 386, 521, 585, 586, 591, 597–600; 220/9.1–9.3

[56] References Cited

U.S. PATENT DOCUMENTS

| | | | |
|---|---|---|---|
| 181,389 | 8/1876 | Archer | 206/83.5 |
| 241,765 | 5/1881 | Wever | 220/9.3 |
| 1,135,892 | 4/1915 | Grosenbeck | 220/9.3 |
| 3,231,084 | 1/1966 | Kean, Sr. | 206/386 |
| 5,143,283 | 9/1992 | Lancaster | 206/320 |
| 5,251,753 | 10/1993 | Pigott et al. | 206/597 |
| 5,271,498 | 12/1993 | Gillespie | 206/586 |
| 5,277,310 | 1/1994 | Mertz | 206/497 |

FOREIGN PATENT DOCUMENTS

| | | | |
|---|---|---|---|
| 0135793 | 11/1978 | Japan | 206/320 |
| 4-142271 | 5/1992 | Japan | 206/586 |

*Primary Examiner*—Jimmy G. Foster

*Attorney, Agent, or Firm*—Polster, Lieder, Woodruff & Lucchesi

[57] ABSTRACT

A paperboard packaging frame for enclosing the perimeter of articles in preparation for receiving wrapping material for the forming of a unitary article package, and an article perimeter enclosing frame having load bearing members formed with honeycomb cellular components.

4 Claims, 3 Drawing Sheets

PERIMETER PACKAGE FOR ARTICLES

BACKGROUND OF THE INVENTION

This invention is directed to an article perimeter package construction in which the package consists of frames for enclosing an article and wherein the frames and the article together are enclosed in stretch wrap material.

The perimeter package hereinafter to be described in detail represents a new way of packaging articles in a stretch wrap fashion which includes frame members that not only protect the article but form a supporting structure to permit article stacking while avoiding damage to or crushing of the packaged article protected by the frames.

An important object of the present invention is directed to perimeter packaging of articles such as chairs, file cabinets, stoves, refrigerators and other articles in a simplified protective perimeter structure, all of which is enclosed in stretch wrap material.

It is an important object of the present invention to create frame members for the perimeter package which are formed in flat layout configuration so that the flat form may be stored in inventory with the minimum of storage space required, but which can be quickly removed from storage and formed into an erect configuration ready for application to perimeter packaging of articles.

It is an object of this invention to form the framing for perimeter packaging that can be attached for use with irregularly shaped objects so as to give form and protection for purposes of stacking. An additional object of the present invention is to combine the perimeter packaging frames with honeycomb load carrying components so that the object to be packaged is adequately protected for convenience in stacking without incurring damage by the weight of other similar articles placed in stacked positions. A further object of the present invention is to provide perimeter packaging of all sorts of articles which heretofor have required the use of wood bases on which the articles are mounted before being packaged.

An additional object of the present invention is to create article perimeter packaging with great attention being directed to creating air circulation when ventilation is required.

Other objects and advantages of the present invention will be set forth in the following specification which is predicated upon drawings to be described hereinafter.

DETAILED DESCRIPTION OF THE DRAWINGS

The perimeter packaging of the present invention is illustrated in the following drawings which include:

DETAILED DESCRIPTION OF THE EMBODIMENT

Figure 1:
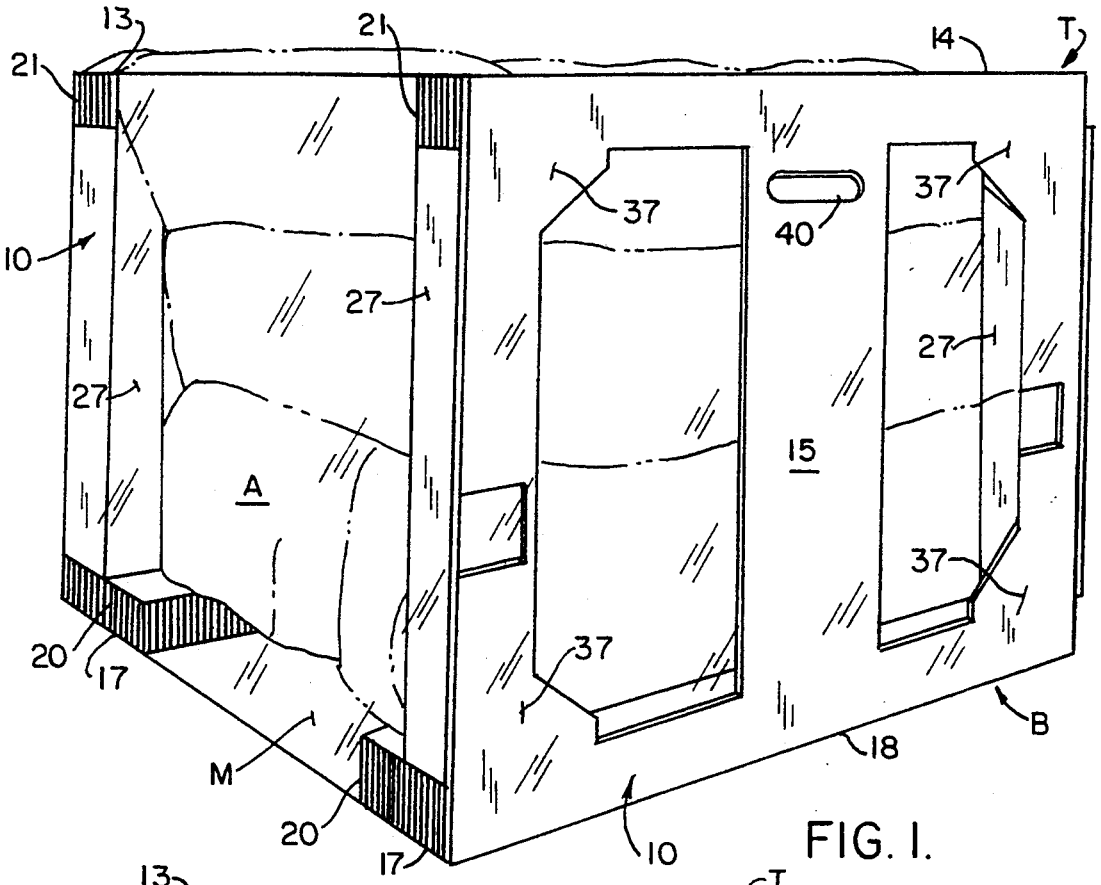
FIG. 1 is a perspective view of a perimeter packaging and stretch wrap assembly enclosing of an article.

With reference to the drawing, and particularly to FIG. 1, there is illustrated an embodiment of the perimeter package which encloses an article A. The package is constituted by a pair of protective frames 10 which are substantially identical, and a stretch material M which is wrapped around the frames 10 to enclose them along with the article A. While article A is an article of foldable furniture, any character of article can be packaged, such as chairs, file cabinets, stoves or refrigerators. In FIG. 1 the wrapper material M is shown to be transparent so the enclosed article can be visually identified. But other types of wrapper materials can be employed in combination with identification tags, labels or the like.

Figure 2:
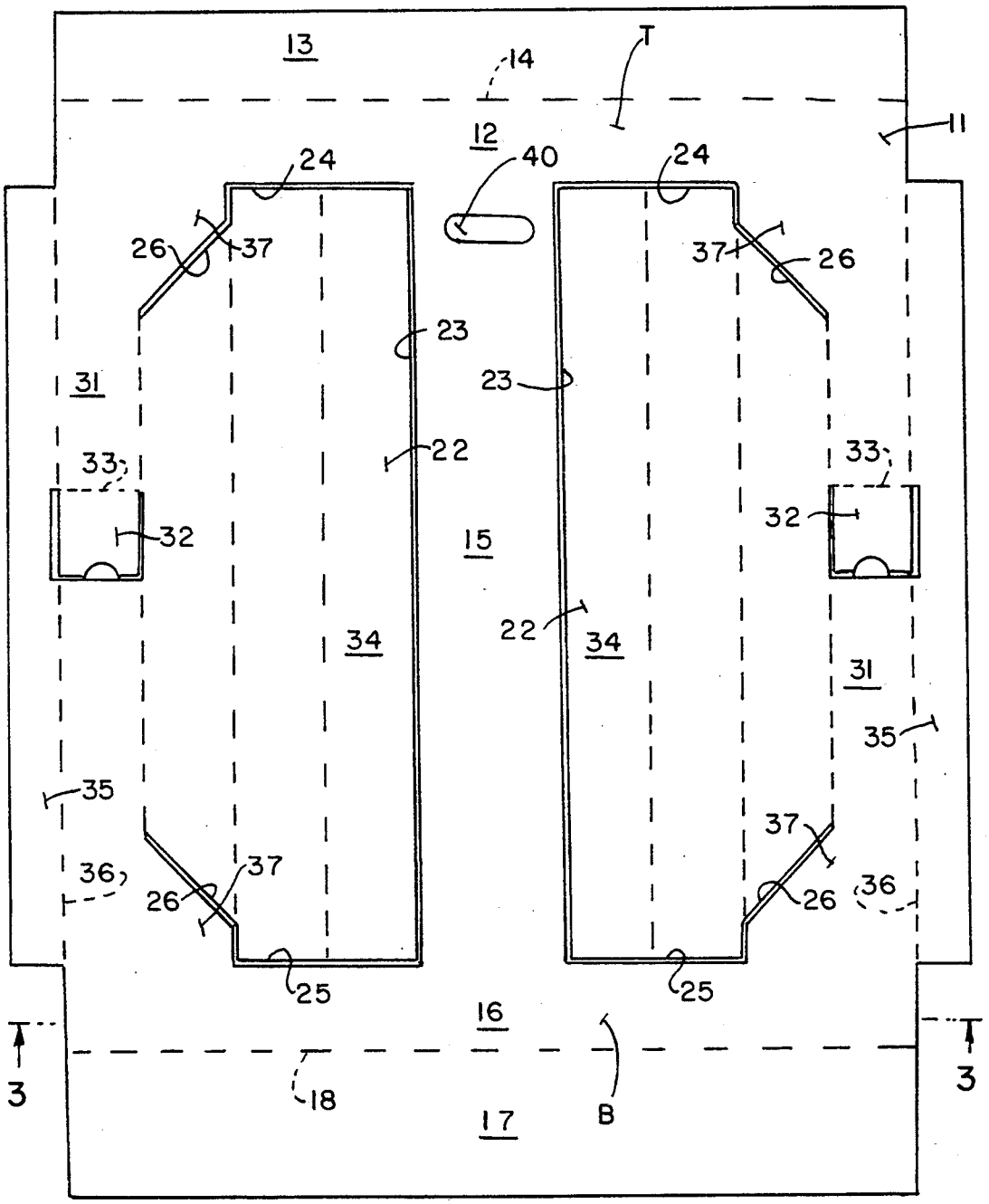
FIG. 2 is a plan view in flat layout of a typical frame which, when erected and placed in cooperation with a like frame, constitutes the article perimeter packaging.
Figure 3:
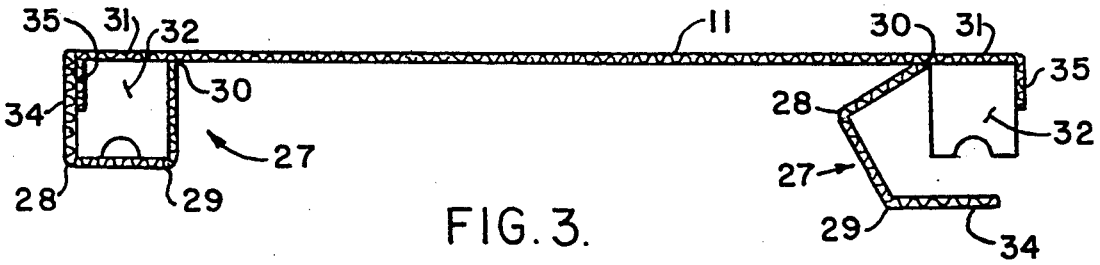
FIG. 3 is a sectional view taken along line 3—3 in FIG. 2 illustrating the shaping of a frame out of a flat layout form thereof.

The protective frames 10 are created from a flat corrugated paper sheet 11 of material which is seen in its flat layout in FIG. 2, and in FIG. 3 in section. The top margin T of the sheet is an elongated strip 12 having a flap 13 as an extension of the margin T to be folded along the fold line 14. The strip 12 remains in the same plane with a centrally located vertical strip 15. That strip 15 extends to a bottom margin B seen as a strip 16 which has a flap 17 as an extension to the bottom B to be foldable along fold line 18. It is to be noted that the bottom foldable extension flap 17 is wider than the top foldable extension flap 13. This is chosen because the wider flap is provided to carry a honeycomb body seen in FIG. 4 at 20 which forms a load bearing footing for the article M. Thus, the top foldable extension flap 13 has a width suitable to be attached to a buffer which is a honeycomb body 21 seen in FIG. 4. The honeycomb bodies 20 and 21 are essentially parallel to each other and provide essential rigidity to the frame 10.

Considering FIG. 2, as well as the view of FIG. 3, there are two panels 22 to be cut and folded out of the central area of flat sheet 11 along internal vertical cuts 23 at each side of the central strip 15, cut at the top strip 12 along an irregular cut 24, and cut at the bottom strip 16 along an irregular cut 25. Thus, each panel 22 separates from the flat sheet 11 along the cut lines 23, 24 and 25, and the diagonal cut lines 26. When each panel is pushed out of the flat sheet 11 they are formed into rectangular corner columns 27 which are shown in FIG. 3. Each panel has fold lines 28, 29 and 30 which in folded positions construct a rectangular form which becomes the column 27. In order to assure the retention of that rectangular shape, the strip 31 of each column which remains in the original flat sheet 11 is die-cut to form a flap 32 cut along three margins so it can be folded along line 33 to remain inside the column, as is clearly seen in FIG. 3. Furthermore, each column is held to the flat sheet 11 by adhesively attaching the panel strips 34 to the flaps 35 which are folded along fold lines 36. While each rectangular vertical column 27 is formed by cutting and outwardly folding the required strips from the central area, the strip 31 remains in the plane of the sheet 11, and is formed with corner stiffener gussets 37.

Figure 4:
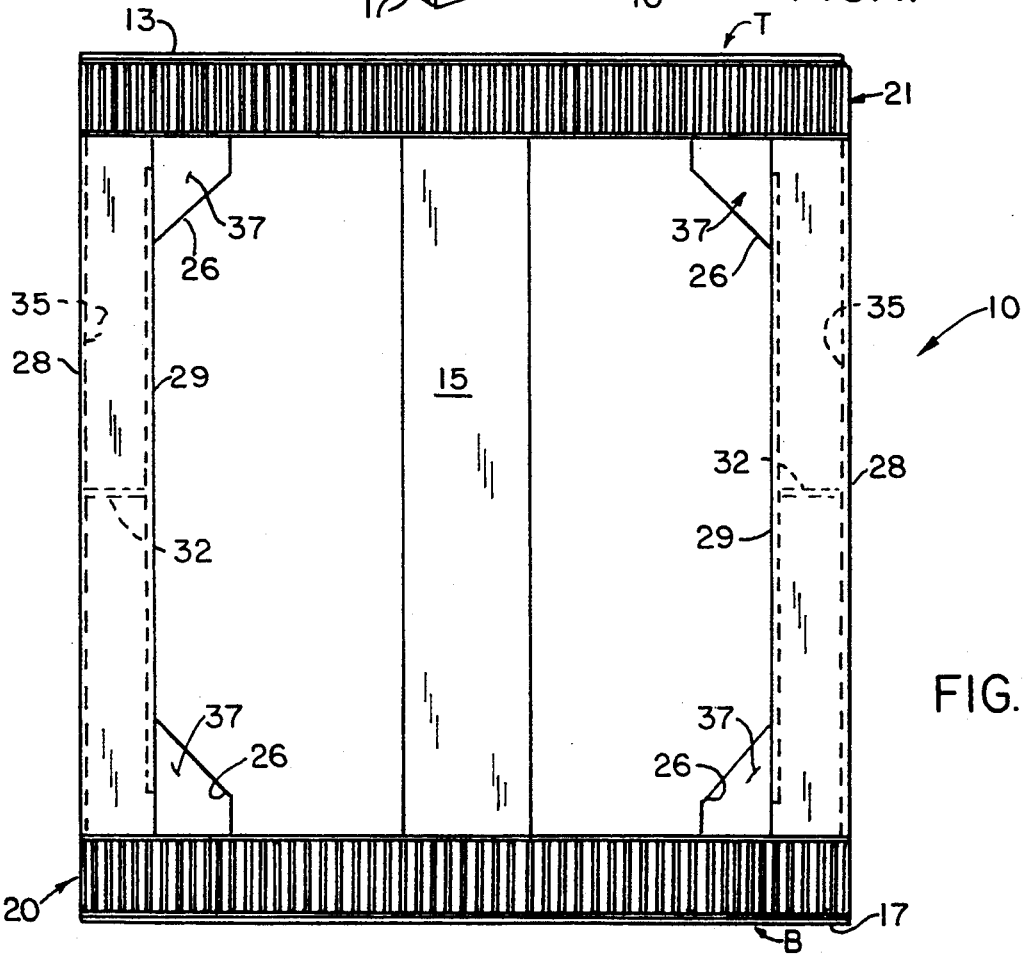
FIG. 4 is a view of a typical frame as seen from the interior side to reveal structural features.

FIG. 4 is a view of a typical frame as observed from the inside that is presented to the article to be packaged. It is recognized that the panels 22 in FIG. 2 have been moved out of the plane of the sheet 11 and folded along lines 28, 29 and 30. At the same time the marginal flaps 35 have been folded so that each can be adhesively secured to the inner surface of flap 34 to retain the panels 22 in columnal form which are retained in a rectangular shape by the bending of the flaps 32 so they occupy the interior of the columns which now form the vertical corners 27 for the frame 10. Each frame 10 is provided with a honeycomb member 20 having the axes of the cells vertical. That member 20 is adhesively secured in position to lie against the bottom strip 16 when extension strip 17 is folded inwardly. Also, each panel 10 carries a buffer honeycomb member 21 which lies against the inside of the top strip 12 and is adhesively mounted to the fold-over strip 13. Again the axes of the cells in the honeycomb member 21 are directed vertically. In addition to the structural effect the honeycomb members 20 and 21 have, the frame is further strengthened by the corner gussets 37.

Figure 5:
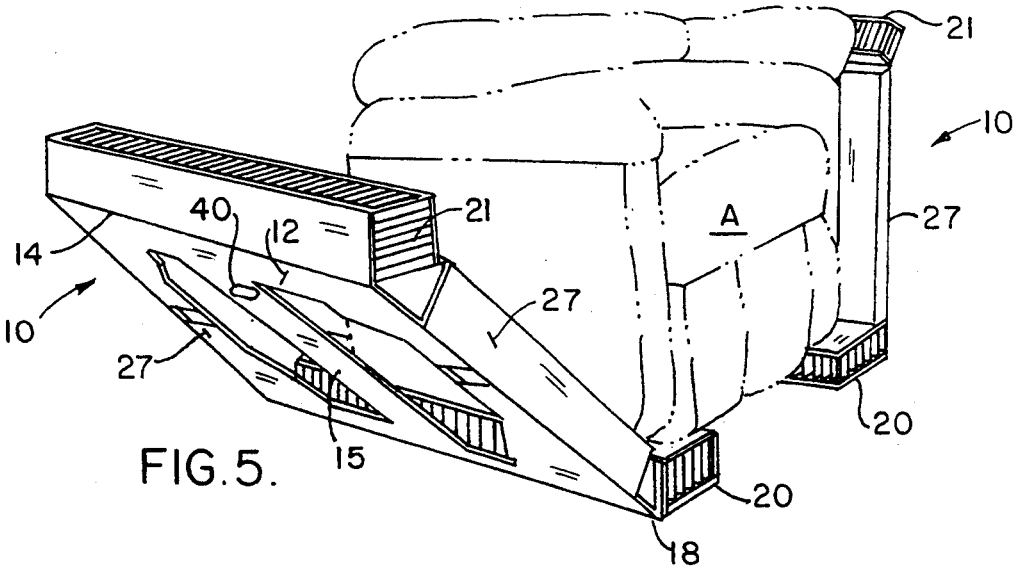
FIG. 5 is a perspective view showing the application of a typical perimeter package frame as semi-applied to an article.
Figure 6:
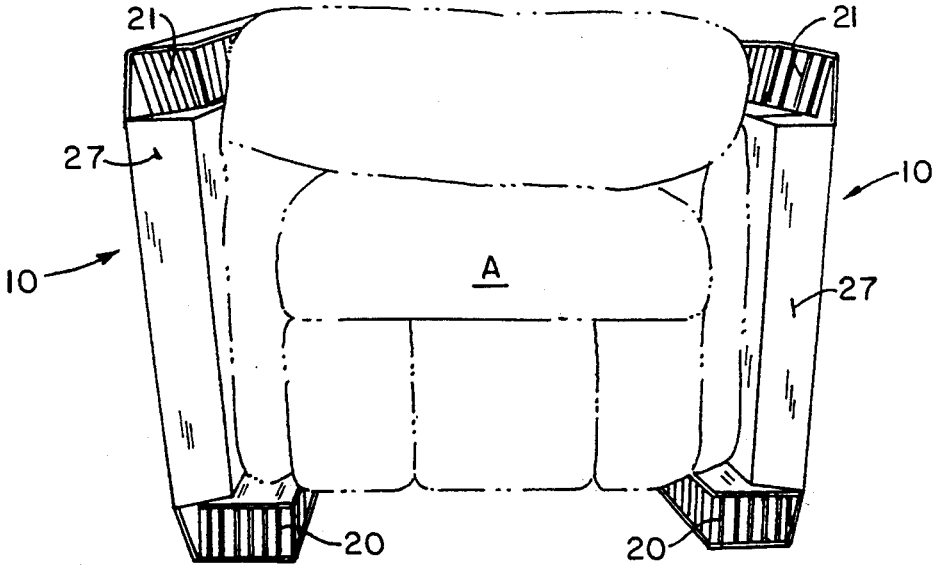
FIG. 6 is a front view of the article partially enclosed in a perimeter frame assembly.

In the view of FIG. 5 and 6, the article A to be packaged is positioned on the honeycomb members 20 so the entire weight of that article A can be distributed over the area provided by the honeycomb cells. Each perimeter frame 10 is adapted to have its bottom strip 16 pivoted upwardly along fold line 18 so the corner columns 27 rest upon the honeycomb members 20. The extension strip 13 which is adhesively connected to the honeycomb buffer member 21 can then be folded along fold line 14 to position the buffer member 21 on top of the corner columns 27 for the purpose of abutting the article A.

Figure 7:
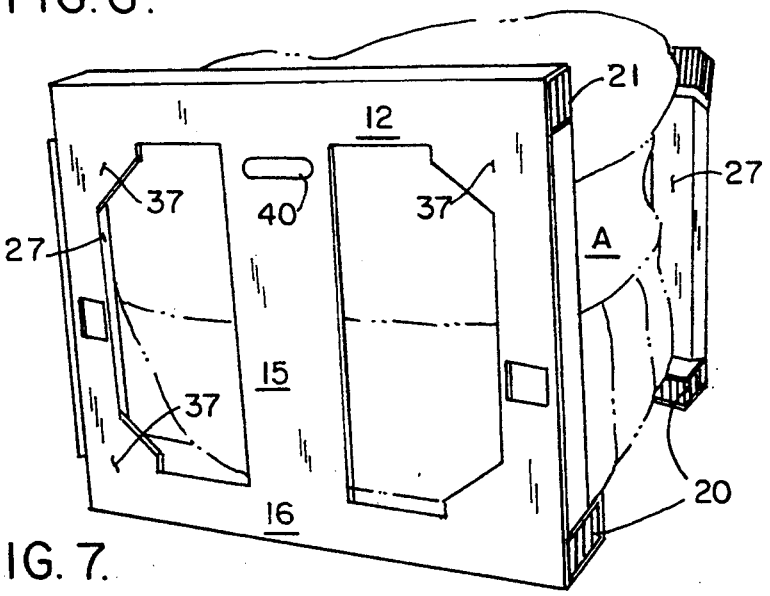
FIG. 7 is a perspective view showing a typical perimeter packaging frame as seen from the exterior thereof.

After installing the perimeter panels 10 as indicated in FIGS. 5, 6 and 7, a wrapping material M is applied, as in FIG. 1, to compress the panels 10 against the article so the weight is carried on the honeycomb members 20 which act as load bearing footings. Additionally, the wrap material holds the honeycomb members 21 as buffers to protect the article A against being disfigured or against being struck by other articles. Handling of the package is performed by the provision of handhold openings 40 formed near the top of the center strip 15 of the frame 10. A hand hold opening is formed upon folding the flaps 32.

Furthermore, the construction of the frames 10 with the honeycomb members 20 and 21 gives a form and shape to the resulting package regardless of the configuration of the article to be perimeter packaged, thereby allowing perimeter packaged articles to be stacked. Also the frames 10 give a package a secure shape that eliminates boxing articles which is a substantial cost saving, and the frames are not used as inserts in an outer enclosing box.

The foregoing description has set forth a preferred embodiment of structure which enables articles to be inexpensively packaged for visual identification, as well as stacking in storage to develop an inventory for subsequent distribution. It is understood that the structure of the perimeter frames may suggest modifications for accomplishing the object of the invention.

What is claimed is:

1. Perimeter packaging for articles comprising a pair of packaging frames, each of said pair of packaging frames comprising spaced vertical columns having tops and bottoms adapted to embrace an article therebetween, load bearing footings interconnecting the bottoms of said columns comprising a body of honeycomb cells the axes of which cells are vertical, said frame members interconnecting the tops of said columns and having a body of honeycomb cells the axes of which are vertical, and package wrapping material enclosing said frames with the article therebetween to form a unitary package.

2. The perimeter packaging set forth in claim 1 wherein each of said packaging frames comprise vertically elongated and horizontally elongated components interconnected to assume positions to protect the article.

3. The perimeter packaging set forth in claim 1 wherein said perimeter packaging consists of paper stock in which said vertical columns are folded out of said paper stock from the same side thereof.

4. The perimeter packaging set forth in claim 1 wherein each of said pair of frames is formed out of initially flat corrugated paper stock and folded into said vertically erect positions forming spaced vertical columns interconnected by horizontal strips, said vertical columns and horizontal strips substantially matching like dimensions of an article to be packaged, and said wrapping material retaining said frames against the article and enclosing the frames and articles to form said unitary package.

* * * * *